US006460970B1

(12) United States Patent
Ohkuma et al.

(10) Patent No.: US 6,460,970 B1
(45) **Date of Patent: *Oct. 8, 2002**

(54) METHOD OF MANUFACTURING NOZZLE PLATE FOR INK JET RECORDING HEAD, INK JET RECORDING HEAD COMPRISING SUCH NOZZLE PLATE, AND INK JET RECORDING APPARATUS COMPRISING SUCH HEAD

(75) Inventors: Norio Ohkuma; Hirokazu Komuro, both of Yokohama; Takashi Fujikawa, Isehara; Ken Tsuchii, Sagamihara; Hideto Yokoi, Yokohama; Shuichi Murakami, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/668,478

(22) Filed: Jun. 25, 1996

(30) Foreign Application Priority Data

Jun. 26, 1995 (JP) ..... 7-159362

(51) Int. Cl.[7] ..... B41J 2/14; B41J 2/16
(52) U.S. Cl. ..... 347/47
(58) Field of Search ..... 347/45, 47

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,608,577 A | | 8/1986 | Hori | 347/66 |
| 4,694,308 A | | 9/1987 | Chan et al. | 347/65 |
| 4,716,423 A | | 12/1987 | Chan et al. | 347/65 |
| 4,723,129 A | | 2/1988 | Endo et al. | 347/56 |
| 4,740,796 A | | 4/1988 | Endo et al. | 347/56 |
| 5,208,604 A | * | 5/1993 | Watanabe et al. | 347/47 |
| 5,331,344 A | | 7/1994 | Miyagawa et al. | 347/65 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |
| JP | 62-234941 | 10/1987 |
| JP | 63-197941 | * 8/1988 |
| JP | 01-280566 | * 11/1989 |

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

The method of the present invention of manufacturing a nozzle plate for an ink jet recording head comprises a first step of forming a layer of a resin comprising a benzene ring on a metal substrate, a second step of patterning the layer of the resin by means of excimer laser and partially exposing the metal substrate, a third step of forming a metal layer having a thickness smaller than that of the resin layer on the exposed surface of the metal substrate by electroforming, and a fourth step of separating the metal layer from the metal substrate and the resin layer.

7 Claims, 5 Drawing Sheets

METHOD OF MANUFACTURING NOZZLE PLATE FOR INK JET RECORDING HEAD, INK JET RECORDING HEAD COMPRISING SUCH NOZZLE PLATE, AND INK JET RECORDING APPARATUS COMPRISING SUCH HEAD

BACKGROUND OF THE INVENTION

1. Field of the Invention

This invention relates to a method of manufacturing a nozzle plate for an ink jet recording head. It also relates to an ink jet recording head comprising such a nozzle plate and an ink jet recording apparatus comprising such an ink jet recording head.

2. Related Background Art

An ink jet recording head used for an ink jet printing system (liquid jet recording system) generally comprises fine discharging orifices, ink flow paths communicating with the respective discharging orifices and liquid discharging energy generating sections disposed at a part of the ink flow paths so that, in each of the ink flow paths, the energy generated by the liquid discharging energy generating section is applied to the liquid (ink) in the ink flow path to cause it to discharge from the orifice. The discharging orifices are integrally provided in a discharging orifice plate which is a member for forming the discharging orifices (hereinafter referred to as "nozzle plate").

A number of methods have been proposed for manufacturing a nozzle plate for an ink jet recording apparatus.

For example, "Hewlett Packard Journal 36, 5 (1985)" discloses a method of manufacturing a nozzle plate for an ink jet recording apparatus provided with discharging orifices, each of which is fine and tapered along the discharging direction. As shown in FIGS. 7A and 7B, the proposed method comprises the steps of providing a resist 52 on a metal substrate 51 and arranging a mask 53 on the resist 52 (see FIG. 7A), electroforming nickel to cover the resist (see FIG. 7B) and peeling off a nickel plate 54 from the metal substrate. However, since the plate produced by electroforming evenly grows from the corners 55 of the resist both in the vertical direction and in the horizontal direction as shown in FIG. 7B, the distance (or density) of arranging discharging orifices and the thickness of the nozzle plate provide a trade-off. Thus, any attempt for producing discharging orifices arranged at a short distance d in order to realize high definition recording can result in a reduction of a nozzle plate thickness t, to thereby give rise to handling problems when bonding the nozzle plate to a member for forming ink flow paths.

Methods proposed to bypass the above problem are disclosed in Japanese Patent Application Laid-Open Nos. 62-234941 and 63-502015.

The method proposed in Japanese Patent Application Laid-Open No. 62-234941 relates to the two-layered structure of a resist which operates as a mask on a metal substrate, whereas Japanese Patent Application Laid-Open No. 63-502015 discloses a method of manufacturing a nozzle plate comprising a step of forming a first resist layer, an electroforming step, a step of forming a second resist-layer and an electroforming step, wherein the ink discharging orifices and the ink flow paths are formed simultaneously.

However, any of the above described methods cannot provide a resist layer having thick areas that are etched to show a desired profile and involves a complex manufacturing process to raise the overall manufacturing cost.

Additionally, in these method, a water repellency treatment is carried out on the face of the discharging portion of an ink jet recording head in order to improve the discharging performance of the head (accuracy of landing ink droplets on a recording member), the water repellency treatment cannot be conducted after the electroforming because the face of the discharging portion is formed at the surface side of the metal substrate.

SUMMARY OF THE INVENTION

In view of the above problems of the prior art, it is therefore an object of the present invention to provide a method of manufacturing a nozzle plate having a desired thickness for an ink jet recording head at a low cost regardless of the density of discharging orifices, with which a water repellency treatment can be carried out without difficulty. Another object of the present invention is to provide an ink jet recording head having a nozzle plate manufactured by such a method and an ink jet recording apparatus comprising such an ink jet recording head.

As a result of intensive research efforts, the inventors of the present invention have succeeded in achieving the above-objects. The first aspect of the present invention is to provide a method of manufacturing a nozzle plate for an ink jet recording head, which comprising:

(a) a first step of forming a layer of a resin comprising a benzene ring on a metal substrate;

(b) a second step of patterning the layer of the resin by means of an excimer laser and partially exposing the metal substrate;

(c) a third step of forming a metal layer having a thickness smaller than that of the resin layer on the exposed surface of the metal substrate by electroforming; and (d) a fourth step of separating the metal layer from the metal substrate and the resin layer.

The second aspect of the present invention is to provide a method of manufacturing a nozzle plate for an ink jet recording head according to the first aspect which further comprise a step of conducting a water repellency treatment on the surface of the metal layer.

The third aspect of the present invention is to provide a method of manufacturing a nozzle plate for an ink jet recording head according to the first aspect, wherein in the third step of forming a metal layer, a plurality of metal layers is superposed and the last metal layer superposed as the surface layer comprises nickel as a main component and TEFLON non-stick coating particles.

The fourth aspect of the present invention is to provide a method of manufacturing a nozzle plate for an ink jet recording head according to the first, the second or the third aspect, wherein the metal layer is made of nickel.

The fifth aspect of the present invention is to provide a method of manufacturing a nozzle plate for an ink jet recording head according to any one of the first to the fourth aspects, wherein the second step of patterning the layer of a resin is conducted in two stages of using two different masks to integrally form ink discharging orifices and ink flow paths.

The sixth aspect of the invention is to provide an ink jet recording head comprising a nozzle plate manufactured by a method according to any one of the first to the fifth aspects.

The seventh aspect of the invention is to provide an ink jet recording apparatus comprising an ink jet recording head according to the sixth aspect.

It may be clear from the above that, with a method of manufacturing a nozzle plate according to the invention, (i) the density of discharging orifices and the thickness of the nozzle plate can be independently controlled to provide a greater extent of designability;

(ii) the overall manufacturing process can be controlled with easy because of a reduced number of manufacturing steps to allow a reduced manufacturing cost;

(iii) the face of the discharging portion can easily be treated for water repellency; and (iv) the nozzle plate can be made to show a desired thickness and a high definition nozzle pattern.

An ink jet recording head prepared by using a nozzle plate according to the present invention and an ink jet recording apparatus comprising such an ink jet recording head operate excellently with an enhanced accuracy of hitting the targets with ink drops because each of the discharging orifices has a smoothly and evenly tapered profile.

DETAILED DESCRIPTION OF THE PREFERRED EMBODIMENTS

Now, the present invention will be described in greater detail by referring to the accompanying drawings that illustrate preferred embodiments of the present invention. FIGS. 1A through 1E illustrate the first to fourth steps of manufacturing a nozzle plate of the present invention.

Figure 1A:
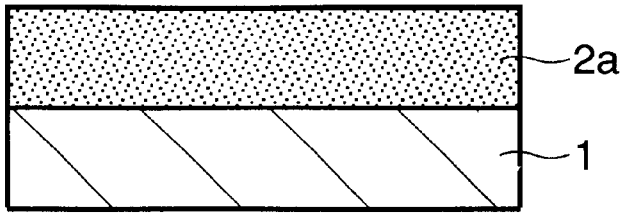
FIGS. 1A through 1E schematically illustrate the steps of manufacturing a nozzle plate for an ink jet recording head according to an embodiment of the present invention.
Figure 1A:
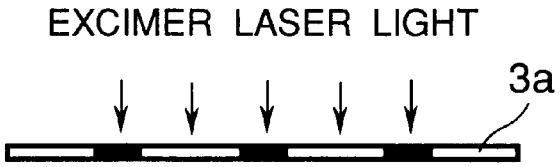
Figure 1B:
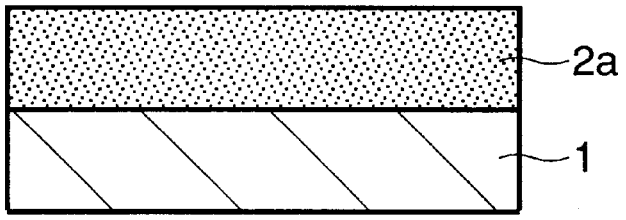

First Step: A resin layer (2*a*) that can effectively be processed by excimer laser is formed on a metal substrate (1) such as stainless steel (FIG. 1A). Though any resins that are apt to react to excimer laser and have a benzene ring may be used for the purpose of the present invention, polysulfone, polyethersulfone, polymethylmethacrylate and derivatives thereof are preferably used. While the thickness of the resin layer (2*a*) depends on the thickness of the nozzle plate to be produced, it is preferably between 10 and 100 $\mu$m.

Figure 1C:
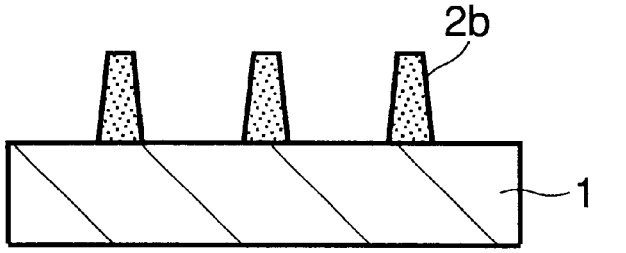

Second Step: The resin layer (2*a*) is irradiated with excimer laser beams via a mask (3*a*) in such a way that the other parts than a part for forming ink discharging orifices are hit by respective laser beams (FIG. 1B) to form a given pattern on the resin layer (2*a*) and partially expose the metal substrate (FIG. 1C). The irradiated parts of the resin layer are decomposed, dispersed and gasified while producing a plasma glow and a crashing sound, whereby the resin layer is patterned without requiring a development process. The density of discharge orifices can be controlled by means of the mask (3*a*). Since the thickness of the film to be processed is not limited by excimer laser, a fine pattern can be produced on a desired film thickness. Since excimer laser is absorbed most on the surface of the resin layer, each orifice formed in the resin layer is tapered. The taper is advantageous in terms of the frequency of driving the ink jet recording head and the directionality of discharged liquid droplets (accuracy of landing ink droplets on a recording member). The angle of taper can be controlled by regulating the focal point of excimer laser and by adding a substance that positively absorbs excimer laser to the resin layer (2*a*).

Figure 1D:
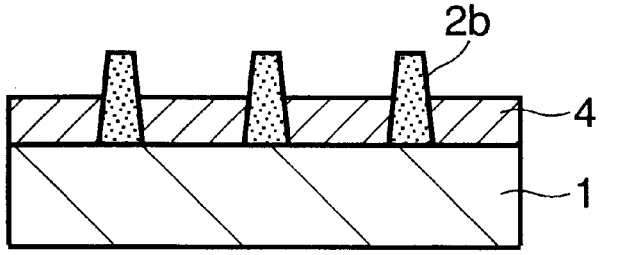

Third Step: A metal layer (4) is formed on the exposed areas of the metal substrate typically by means of electroforming or the like (FIG. 1D). When carrying out electroforming, any metals that are feasible for electroforming may be used for the purpose of the present invention, nickel is preferably used.

Figure 2:
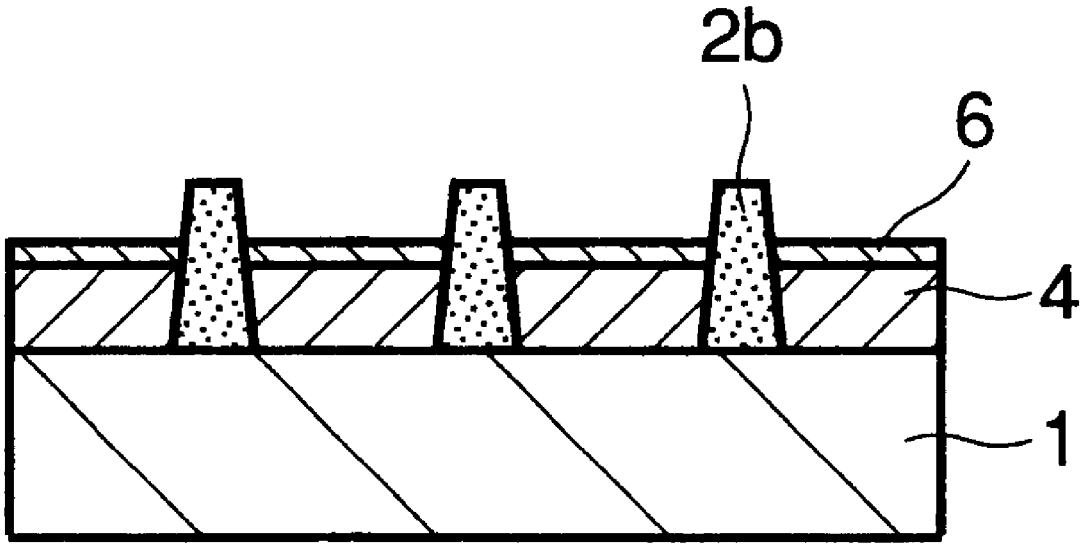
FIG. 2 is a schematic sectional view of a nozzle plate for an ink jet recording head according to the present invention in the third manufacturing step, where a water repellent layer is formed on a metal layer.

The surface of the metal layer can be treated for water repellency without difficulty in the above Third Step. Water repellency treatment can be carried out by forming a layer (6) of a water repellent material on the surface of the metal layer (4) (FIG. 2). A water repellent layer may be produced, e.g., by superposing a layer of an organic resin containing fluorocarbon typically via a silane coupling agent on the metal layer. While the water repellency treatment does not necessarily have to be carried out in the Third Step, the treatment in the Third Step provides the most preferable choice from the viewpoint of the entire operation. A water repellent layer may alternatively be formed by superposing a plurality of metal layers, the uppermost one of which is made to contain TEFLON particles. Nickel is most preferably used for the metal layer containing TEFLON particles. Since ink discharging orifices are formed on the side of the metal substrate (1) opposite to the surface thereof according to the present invention, a water repellency treatment can be conducted without difficulty.

When a plurality of metal layers are superposed, a metal that can be bonded easily for manufacturing an ink jet recording head may advantageously be selected for the first layer to be formed on the metal substrate.

Figure 1E:
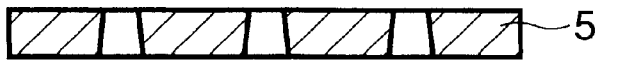

Fourth Step: The metal layer (4) is separated from the metal substrate (1) and the resin layer (2*b*) to produce a nozzle plate (5) for an ink jet recording head (FIG. 1E).

While the basic manufacturing steps for manufacturing a nozzle plate for an ink jet recording head according to the present invention are described above, the patterning operation in the Second Step may alternatively be carried out in two steps using two different masks respectively. The ink discharging orifices (12) and the corresponding respective ink flow paths (13) may be formed integrally to manufacture a nozzle plate for an ink jet recording head. A method comprising such steps will be described by referring to FIGS. 3A through 3F.

First Step: A resin layer (2*a*) that can effectively be processed by excimer laser is formed on a metal substrate (1) such as stainless steel (not shown).

Figure 3A:
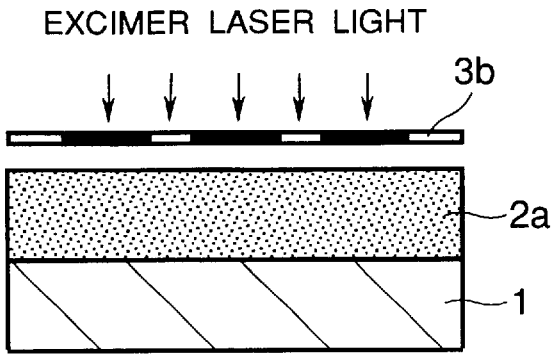
FIGS. 3A through 3F schematically illustrate the steps of manufacturing a nozzle plate for an ink jet recording head according to another embodiment of the present invention.
Figure 3B:
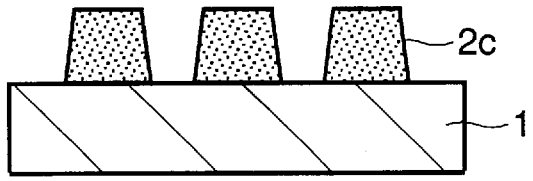

Second Step: The resin layer (2*a*) is irradiated with excimer laser beams via a mask (3*b*) in such a way that the other parts than a part for forming ink discharging orifices and corresponding ink flow paths are hit by respective laser beams (FIG. 3A) to thereby decompose and remove the other part of the resin layer (2*a*) and produce a resin layer (2*c*) having a desired pattern where the metal substrate is partially exposed (FIG. 3B).

Figure 3C:
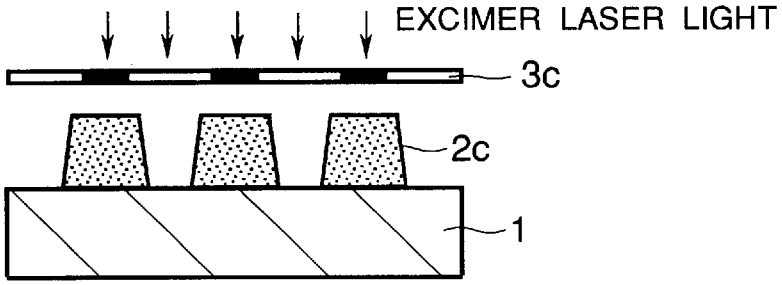
Figure 3D:
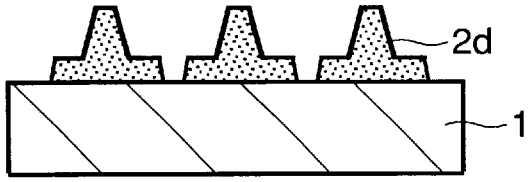

Subsequently, the other parts than a part for forming the ink discharging orifices are irradiated with excimer laser beams via a mask (3*c*) to produce a given pattern on the resin layer (2*c*) (FIG. 3C). The patterning operation may be stopped in the middle of the resin layer by controlling the excimer laser irradiation to produce a further patterned resin layer (2*d*) (FIG. 3D).

Figure 3E:
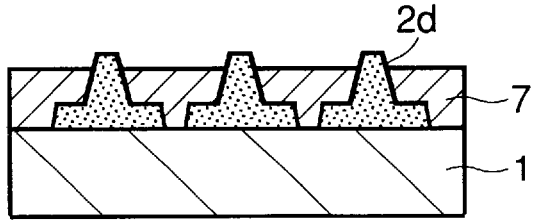

Third Step: A metal layer (7) is formed on the exposed areas of the metal substrate typically by means of electroforming or the like (FIG. 3E). Any metals that are feasible for electroforming may be used for the purpose of the present invention, the use of nickel is preferable. The surface of the metal layer may be treated for water repellency or a water repellent layer may be formed on the top of the metal layer. When a plurality of metal layers are superposed, a metal that can be bonded easily for manufacturing an ink jet recording head may advantageously be selected for the first layer to be formed on the metal substrate (1).

Figure 3F:
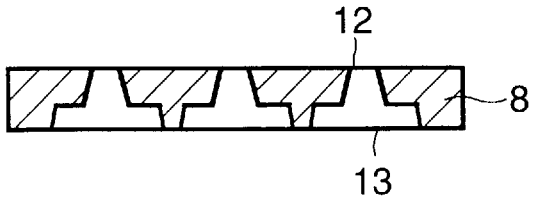

Fourth Step: The metal layer (7) is separated from the metal substrate (1) and the resin layer (2*d*) to produce a nozzle plate (8) for an ink jet recording head (FIG. 3F).

With either of the above described two manufacturing methods, ink discharging orifices may be arranged zigzag in two rows.

Figure 4:
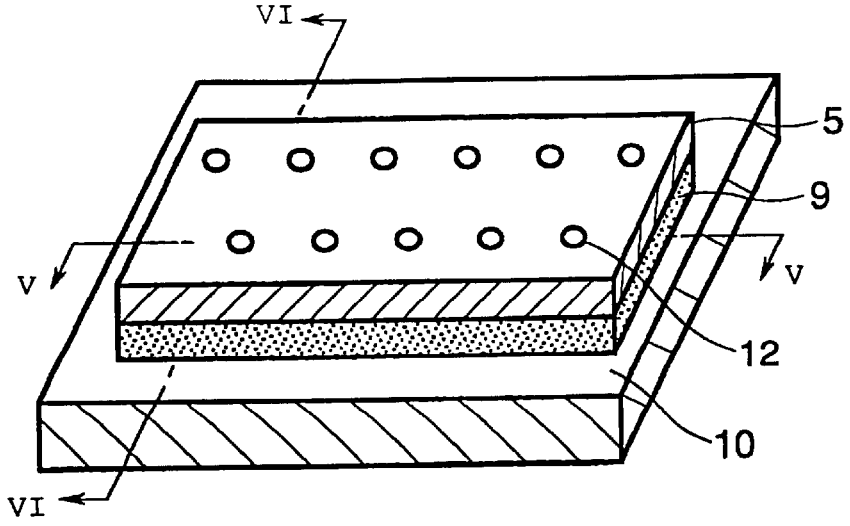
FIG. 4 is a schematic perspective view of an ink jet recording head according to the present invention.
Figure 5:
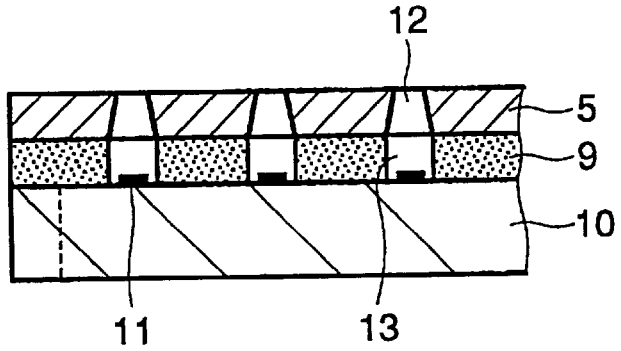
FIG. 5 is a schematic sectional view of the ink jet recording head of FIG. 4 taken along line V—V.
Figure 6:
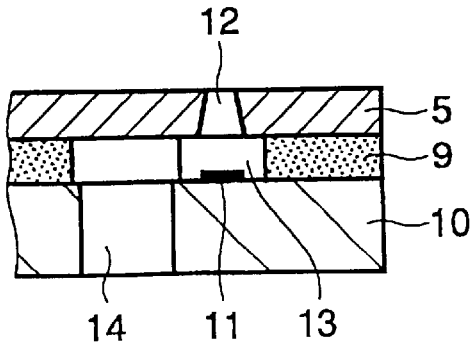
FIG. 6 is a schematic sectional view of the ink jet recording head of FIG. 4 taken along line VI—VI.
Figure 7A:
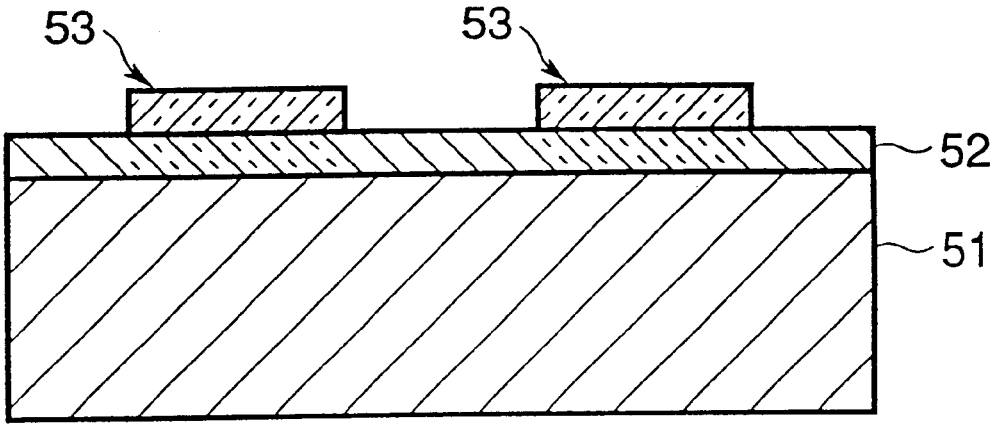
PRIOR ART FIG.7A
FIGS. 7A and 7B schematically illustrate the steps of manufacturing a conventional nozzle plate for an ink jet recording head.
Figure 7B:
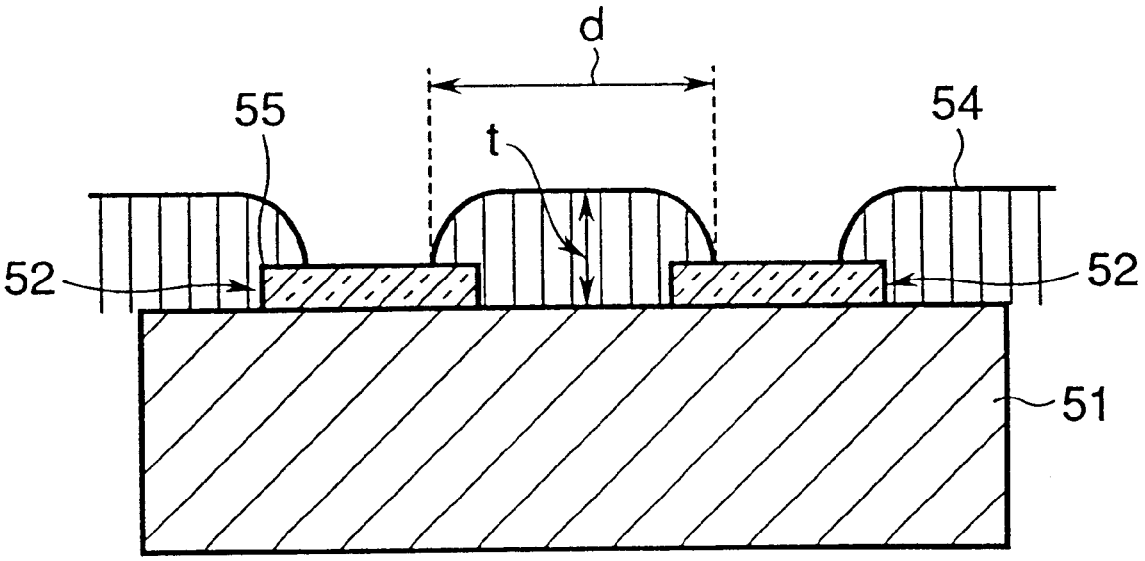
PRIOR ART FIG.7B

Now, an ink jet recording head according to the present invention will be described. FIG. 4 shows a schematic perspective view of an ink jet recording head according to the present invention. FIG. 5 is a schematic sectional view of the ink jet recording head of FIG. 4 taken along line V—V and FIG. 6 is a schematic sectional view of the ink jet recording head of FIG. 4 taken along line VI—VI.

An ink jet recording head according to the present invention is produced by bonding a nozzle plate (5) manufactured by a method according to the present invention to a recording head substrate (10) via a wall member (9) interposed therebetween. The recording head substrate (10) is provided with discharging means (11) (electro-thermal converting elements or piezoelectric elements) and ink feeding opening (14).

Alternatively, a nozzle plate (8) for an ink jet recording head comprising integrally formed ink discharging orifices (12) and ink flow paths (13) may be directly bonded to a recording head substrate (10) without using a wall member (9).

Among ink jet recording systems, particularly in use of an ink jet recording head and an ink jet recording apparatus utilizing thermal energy for discharging liquid droplets, the nozzle plate according to the present invention exhibits an advantageous effect.

The basic constitution and principle of a recording head and an ink jet recording apparatus disclosed in, for example, U.S. Pat. Nos. 4,723,129 or 4,740,796 may advantageously be used for the purpose of the present invention.

The principle described in the above patent documents may be adapted for both on-demand type and continuous type apparatus, and particularly it is advantageously used for the on-demand type apparatus. In an on-demand type ink jet recording apparatus, one or more driving signals corresponding to the data to be recorded and abruptly raising the temperature of the liquid beyond nuclear boiling point are applied to a sheet retaining liquid (ink) thereon or the electro-thermal converters of the apparatus arranged in the respective liquid paths to cause the electro-thermal converters to generate thermal energy and give rise to film boiling on the heat actuating surface of the recording head so that bubbles are formed in the liquid (ink) in one-to-one correspondence to the driving signal. Ink is discharged from each ink discharging orifice by growing or shrinking the bubbles to form and fly one or more ink droplets.

If the driving signal is a pulse signal, the bubbles grow or shrink instantaneously and adequately in response to the applied signal to show an excellent ink discharge performance. Driving signals described in U.S. Pat. Nos. 4,463,359 or 4,345,262 can advantageously be used for the purpose of the present invention. An excellent recording effect can be obtained by utilizing the conditions for temperature rise on the heat actuating surface of the recording head that are described in U.S. Pat. No. 4,313,124.

An ink jet recording head according to the present invention may have a constitution as described in any of the above patent documents, wherein discharging orifices, ink flow paths and electro-thermal converters are used in combination. Alternatively, a constitution of each thermally activated section being placed in a curved area as described in U.S. Pat. Nos. 4,558,333 or 4,459,600 may be used.

Further, an arrangement wherein a common slit to a plurality of electro-thermal converters is used as a discharging part of a plurality of electro-thermal converters (as disclosed in Japanese Patent Application Laid-Open No. 59-123670) or an arrangement wherein openings for absorbing pressure waves of thermal energy are juxtaposed in correspondence to the respective discharging orifices (as disclosed in Japanese Patent Application Laid-Open No. 59-138461) may also be used for the purpose of the invention.

Still further, an ink jet recording head according to the present invention may be a full-line type ink jet recording head that can be adapted to the largest printable width of a recording apparatus. Such a full-line type ink jet recording head may be realized by combining a plurality of recording heads according to any of the above described patent documents. Such a plurality of recording heads may or may not be combined into an integral unit for the purpose of the present invention.

Other types of ink jet recording head that can feasibly be used for the purpose of the present. invention include a detachable chip type recording head that allows an electric connection between the recording head and the main body of ink jet recording apparatus and/or an ink supply from the main body, and a cartridge type recording head integrally provided with an ink tank.

A recovering means and other supplementary means may advantageously be added to an ink jet recording head according to the present invention as the constitutional part of an ink jet recording apparatus in order to enhance the effect of the present invention. Such means typically include capping means, cleaning means, pressurizing/sucking means, pre-heating means, pre-discharging means and the like.

An ink jet recording apparatus according to the present invention may be provided with a number of different recording modes of a mono-color such as black color, of a plurality of different colors and of a full-color by color mixing.

The ink jet recording head and the ink jet recording apparatus according to the present invention as described above utilize an ink in a liquid state, they may be used with solid ink that is softened or liquefied at room temperature or at higher temperature. Since ink is generally heated to a temperature between 30° C. and 70° C. in the ink jet system in order to stabilize the viscosity of the ink, any ink that becomes liquid in that temperature range when recording signals are applied thereto may feasibly be used for the purpose of the present invention. Such ink is liquefied by applying thermal energy thereto which corresponds to the recording signal fed to the recording head, discharged as a liquid ink and solidified immediately when it reaches to the recording medium. The use of such ink is advantageous because rise in temperature can be avoided due to excessive thermal energy when it is liquefied and, at the same time, evaporation of ink can be avoided by use of an ink which is solid at room temperature or solidified immediately after the ink discharging.

Ink may be retained in recesses and/or through holes in a porous sheet in a liquid or solid state and may be arranged in juxtaposition relative to the corresponding electrothermal converters (as disclosed in Japanese Patent Application Laid-Open Nos. 54-56847 and 60-71260).

The film boiling system is most effectively used with any ink of the above described types in the present invention.

An ink jet recording apparatus according to the present invention may be provided integrally or separately with an image output terminal of an information processing apparatus such as a word processor or a computer. Alternatively, it may be combined with a character reader in a copying machine or a facsimile machine having data transmission/reception function.

Now, the present invention will be described further by the following Examples, but it is not limited to the Examples.

EXAMPLE 1

In this example, a nozzle plate for an ink jet recording head was prepared according to the method of the present invention. FIGS. 1A through 1E schematically illustrate the manufacturing steps of Example 1. The manufacturing steps of Example 1 are described below with reference to FIGS. 1A through 1E.

Step 1: A resin layer (2*a*) of polyethersulfone was formed to a thickness of 70 $\mu$m on a metal substrate (1) of stainless steel (FIG. 1A).

Step 2: The resin layer was irradiated with excimer laser via a mask (3*a*) in such a way that the other parts than a part for forming ink discharging orifices are hit by respective laser beams (FIG. 1B) to form a given pattern on the resin layer (2*a*) and partially expose the metal substrate (FIG. 1C). The angle of taper of the orifices was controlled by regulating the focal point of excimer laser.

Step 3: A metal layer (4) was formed on the exposed areas of the metal substrate by electroforming (FIG. 1D). Nickel was used for the metal layer (4).

Step 4: The metal layer (4) was separated from the metal substrate (1) and the resin layer (2*b*) to produce a nozzle plate (5) having a thickness of 50 $\mu$m for an ink jet recording head (FIG. 1E).

The discharging orifices of this example of nozzle plate was formed to have a desired tapered shape:with good accuracy.

EXAMPLE 2

In this example, a nozzle plate for an ink jet recording head was prepared in the same manner as in Example 1 except that a water repellency treatment was carried out after forming the metal layer (4) and before removing the resin layer in Step 3. For the water repellency treatment, an organic resin layer containing fluorocarbon was formed via a silane coupling agent on the surface of the metal layer (4).

The discharging orifices of this example of nozzle plate was formed to have a desired tapered shape with good accuracy.

Since as the water repellency treatment of this example a resin layer was provided on the discharging portion, the inside of the discharging orifices was not treated for water repellency.

EXAMPLE 3

In this example, a nozzle plate for an ink jet recording head was prepared in the same manner as in Example 1 except that a nickel layer containing TEFLON particles was formed on the surface of the nickel layer in Step 3.

The discharging orifices of this example of nozzle plate was formed to have a desired tapered shape with good accuracy.

Since as a water repellency treatment a resin layer was provided on the discharging portion, the inside of the discharging orifices was not treated for water repellency.

EXAMPLE 4

In this example, a nozzle plate for an ink jet recording head was prepared according to the method of the present invention. In this nozzle plate, the ink discharging orifices and the corresponding respective ink flow paths were formed integrally. FIGS. 3A through 3F schematically illustrate the manufacturing steps of Example 4. The manufacturing steps of Example 4 are described below with reference to FIGS. 3A through 3F.

Step 1: A resin layer (2*a*) of polyethersulfone was formed on a metal substrate (1) of stainless steel (not shown).

Step 2: The resin layer was irradiated via a mask (3*b*) with excimer laser beams in such a way that the other parts than a part for forming ink discharging orifices and corresponding ink flow paths were hit by respective laser beams (FIG. 3A) to decompose and remove the other parts of the resin layer (2*a*) and produce a resin layer (2*c*) having a desired pattern where the metal substrate was partially exposed (FIG. 3B).

Subsequently, the other parts of the resin layer (2*c*) than a part for forming the ink discharging orifices were irradiated with excimer laser beams via a mask (3*c*) interposed therebetween to carry out a given pattern on the resin layer (2*c*) (FIG. 3C). The patterning operation was stopped in the middle of the resin layer by controlling the excimer laser irradiation to produce a patterned resin layer (2*d*) (FIG. 3D).

Step 3: A metal layer (7) was formed on the exposed areas of the metal substrate by electroforming (FIG. 3E). Nickel was used for the metal layer.

Step 4: The metal layer (7) was separated from the metal substrate (1) and the resin layer (2*d*) to produce a nozzle plate (8) for an ink jet recording head (FIG. 3F).

The discharging orifices of this example of nozzle plate was formed to have a desired tapered shape with good accuracy.

EXAMPLE 5

In this example, a nozzle plate for an ink jet recording head was prepared in the same manner as in Example 4 except that a water repellency treatment was carried out after forming the metal layer (4) in Step 3. For the water repellency treatment, an organic resin layer containing fluorocarbon was formed by way of a silane coupling agent on the surface of the metal layer (4).

The discharging orifices of this example of nozzle plate was formed to have a desired tapered shape with good accuracy.

Since as the water repellency treatment of this example a resin layer was provided on the discharging portion, the inside of the discharging orifices was not treated for water repellency.

EXAMPLE 6

In this example, a nozzle plate for an ink jet recording head was prepared in the same manner as in Example 4 except that a nickel layer containing TEFLON particles was formed on the surface of the nickel layer in Step 3.

The discharging orifices of this example of nozzle plate was formed to have a desired tapered shape with good accuracy.

Since as a water repellency treatment a resin layer was provided on the discharging portion, the inside of the discharging orifices was not treated for water repellency.

EXAMPLE 7

In this example, ink jet recording heads were prepared by using the nozzle plate of Examples 1, 2 and 3 respectively. FIG. 4 is a schematic perspective view of any of the ink jet recording heads of this example, FIG. 5 is a schematic sectional view of the ink jet recording head of FIG. 4 taken along line V—V and FIG. 6 is a schematic sectional view of the ink jet recording head of FIG. 4 taken along line VI—VI. Each of the nozzle plates was bonded to a recording substrate (10) via a wall member (9) interposed therebetween to produce an ink jet recording head. The recording head substrate (10) was provided with discharging means (11) (electro-thermal converting elements) and ink feeding ports (14).

Each of the ink jet recording heads prepared by using a nozzle plate according to the present invention exhibited excellent characteristics of discharging an ink.

EXAMPLE 8

In this example, ink jet recording heads were prepared by using the nozzle plate of Examples 4, 5 and 6 respectively in the same manner as in Example 7 except that a wall member (9) was not used between the nozzle plate and the recording head substrate (10).

Each of the ink jet recording heads prepared by using a nozzle plate according to the present invention exhibited excellent characteristics of discharging an ink.

EXAMPLE 9

In this example, ink jet recording apparatus were prepared by using the ink jet recording heads of Examples 7 and 8, respectively. Each of the ink jet recording apparatus prepared by using an ink jet recording head according to the present invention operated excellent characteristics of discharging an ink.

What is claimed is:

1. A method of manufacturing a nozzle plate having a plurality of orifices for an ink jet recording head, which comprises the steps of:

forming a layer composed of a resin having a benzene ring structure on a metal substrate;

irradiating the layer composed of the resin with an excimer laser using a mask for shielding portions for forming the plurality of orifices from the excimer laser to ablate the layer composed of the resin until the metal substrate is partly exposed and a portion of the resin that becomes a discharging orifice remains, thereby forming a plurality of protruded patterns each having a tapered shape;

forming a metal layer having a thickness smaller than that of the plurality of protruded patterns on the exposed part of the metal substrate by electroforming; and removing the metal substrate and the plurality of protruded patterns from the metal layer to form a nozzle plate having a plurality of orifices each having the tapered shape.

2. A method of manufacturing a nozzle plate for an ink jet recording head according to claim 1, further comprising a step of conducting a water repellency treatment on the surface of the metal layer.

3. A method of manufacturing a nozzle plate for an ink jet recording head according to claim 1, wherein in the step of forming a metal layer a plurality of metal layers are superposed and the last metal layer formed as the surface layer comprises nickel as a main component and TEFLON particles.

4. A method of manufacturing a nozzle plate for an ink jet recording head according to claim 1, wherein the metal layer is made of nickel.

5. A method of manufacturing a nozzle plate for an ink jet recording head according to any one of claims 1 to 4, wherein the step of irradiating the layer of the resin is conducted in two stages of using two different masks to integrally form ink discharging orifices and ink flow paths.

6. An ink jet recording head comprising a nozzle plate having a plurality of orifices, manufactured by a method comprising the steps of:

forming a layer composed of a resin having a benzene ring structure on a metal substrate;

irradiating the layer composed of the resin with an excimer laser using a mask for shielding portions for forming the plurality of orifices from the excimer laser to ablate the layer composed of the resin until the metal substrate is partly exposed and a portion of the resin that becomes a discharging orifice remains, thereby forming a plurality of protruded patterns each having a tapered shape;

forming a metal layer having a thickness smaller than that of the plurality of protruded patterns on the exposed part of the metal substrate by electroforming; and removing the metal substrate and the plurality of protruded patterns from the metal layer to form a nozzle plate having a plurality of orifices each having the tapered shape.

7. An ink jet recording apparatus comprising an ink jet recording head, said ink jet recording head comprising a nozzle plate having a plurality of orifices, manufactured by a method comprising the steps of:

forming a layer composed of a resin having a benzene ring structure on a metal substrate;

irradiating the layer composed of the resin with an excimer laser using a mask for shielding portions for forming the plurality of orifices from the excimer laser to ablate the layer composed of the resin until the metal substrate is partly exposed and a portion of the resin that becomes a discharging orifice remains, thereby forming a plurality of protruded patterns each having a tapered shape;

forming a metal layer having a thickness smaller than that of the plurality of protruded patterns on the exposed part of the metal substrate by electroforming; and removing the metal substrate and the plurality of protruded patterns from the metal layer to form a nozzle plate having a plurality of orifices each having the tapered shape.

* * * * *

UNITED STATES PATENT AND TRADEMARK OFFICE

CERTIFICATE OF CORRECTION

PATENT NO. : 6,460,970 B1
DATED : October 8, 2002
INVENTOR(S) : Norio Ohkuma et al.

It is certified that error appears in the above-identified patent and that said Letters Patent is hereby corrected as shown below:

Column 1,
Line 41, “evenly grows” should read -- grows evenly --.
Line 64, “above described” should read -- above-described --.

Column 2,
Line 1, “method,” should read -- methods, --.
Line 23, “above-objects.” should read -- above objects. --.
Line 25, “comprising.” should read -- comprises: --.
Line 40, “comprise” should read -- comprises --.

Column 3,
Line 5, “easy” should read -- ease --.
Line 60, “other parts” should read -- parts other --.

Column 4,
Lines 59 and 65, “other parts” should read -- parts other --.

Column 5,
Line 19, “above described” should read -- above-described --.
Line 20, “zigzag” should read -- in a zigzag pattern --.

Column 6,
Line 32, “above described” should read -- above-described --.
Line 36, “head” should read -- heads --.
Line 37, “present.” should read -- present --.

Column 7,
Line 15, “above described” should read -- above-described --.
Lines 53 and 66, “was” should read -- were --.
Line 53, “shape:with” should read -- shape with --.

UNITED STATES PATENT AND TRADEMARK OFFICE

CERTIFICATE OF CORRECTION

PATENT NO. : 6,460,970 B1
DATED : October 8, 2002
INVENTOR(S) : Norio Ohkuma et al.

It is certified that error appears in the above-identified patent and that said Letters Patent is hereby corrected as shown below:

Column 8,
Lines 12, 53 and 66, "was" should read -- were --.
Line 31, "other parts" should read -- parts other --.
Line 39, "other parts of the resin layer (2c)" should read -- parts of the resin layer (2c) other --.

Column 9,
Line 12, "was" should read -- were --.
Line 52, "operated" should read -- displayed --.

Signed and Sealed this

Eleventh Day of March, 2003

JAMES E. ROGAN
*Director of the United States Patent and Trademark Office*